US006349898B1

(12) United States Patent
Leonard et al.

(10) Patent No.: US 6,349,898 B1
(45) Date of Patent: Feb. 26, 2002

(54) METHOD AND APPARATUS PROVIDING AN INTERFACE BETWEEN AN AIRCRAFT AND A PRECISION-GUIDED MISSILE

(75) Inventors: James V. Leonard, Saint Charles; Robert K. Menzel, Lack St. Louis; Richard E. Meyer; James A. Simms, both of Florissant, all of MO (US)

(73) Assignee: The Boeing Company, Seattle, WA (US)

( * ) Notice: Subject to any disclaimer, the term of this patent is extended or adjusted under 35 U.S.C. 154(b) by 0 days.

(21) Appl. No.: 09/507,802

(22) Filed: Feb. 22, 2000

Related U.S. Application Data

(60) Provisional application No. 60/165,696, filed on Nov. 16, 1999.

(51) Int. Cl.[7] ..... F41G 7/00

(52) U.S. Cl. ..... 244/3.15; 244/3.11; 244/3.14; 244/3.19; 342/62

(58) Field of Search ..... 244/3.1, 3.15, 244/3.16–3.22, 3.11–3.14; 342/61–65, 52, 58, 60

(56) References Cited

U.S. PATENT DOCUMENTS 3,856,237 A * 12/1974 Torian et al. ..... 244/3.11
5,429,322 A 7/1995 Waymeyer
5,435,503 A 7/1995 Johnson, Jr. et al.
5,487,322 A 1/1996 Rhodes
5,541,839 A 7/1996 Mitzkus et al.
5,548,510 A 8/1996 Ebert et al.
5,931,874 A 8/1999 Ebert et al.

FOREIGN PATENT DOCUMENTS

GB 2148465 A * 5/1985 ..... F41G/7/00

* cited by examiner

*Primary Examiner*—Bernarr E. Gregory
(74) *Attorney, Agent, or Firm*—Alston & Bird LLP

(57) ABSTRACT

An interface between an aircraft and a precision-guided missile having automatic target recognition capability receives target image data and target location data from the aircraft, translates the data into formats usable by the missile, and downloads the target data to the missile at any time prior to launch of the missile. The interface includes a mission-planning unit and a terrain and elevation data storage unit enabling the air crew to call up terrain and elevation data on a visual display for planning a missile mission, and to transmit mission parameters to the missile during aircraft flight.

16 Claims, 2 Drawing Sheets

METHOD AND APPARATUS PROVIDING AN INTERFACE BETWEEN AN AIRCRAFT AND A PRECISION-GUIDED MISSILE

CROSS-REFERENCE TO RELATED APPLICATION

This application claims the benefit of U.S. Provisional Application No. 60/165,696, filed Nov. 16, 1999.

FIELD OF THE INVENTION

The present invention relates generally to a signal conditioning method and apparatus and, more particularly, to a method and apparatus for providing an electrical interface between an aircraft and an associated store.

BACKGROUND OF THE INVENTION

Modern aircraft, such as an F-15E aircraft manufactured by the assignee of the present invention, and the P-3, the S-3 and the F-16 aircraft manufactured by Lockheed Aeronautical Systems Company, are adapted to carry stores. These stores can, for example, include missiles, such as the Walleye missile, the Standoff Land Attack missile (SLAM), the Harpoon missile, and the Maverick missile. A missile is generally mounted to the wing of a host aircraft, typically via disconnectable pylons, such that the aircraft can carry the missile to the vicinity of the target destination prior to its deployment.

Prior to, during and even after deployment of a store, the aircraft and the associated store communicate. For example, signals are bidirectionally transmitted between the aircraft and the store to appropriately configure and launch the store. This prelaunch configuration can include downloading the coordinates of the target and initializing the various sensors of the store. In addition, a store, such as a SLAM missile, can transmit a video image, typically via radio frequency (RF) signals, of the target to the aircraft after deployment so that the flight path of the store can be monitored, and, in some instances, controlled to provide greater targeting accuracy.

In order to provide bidirectional signal transmission between the aircraft and the associated store, a host aircraft typically includes an aircraft controls and displays module. The aircraft controls and displays module provides an interface by which the crew of the aircraft can monitor and control their flight pattern and can provide armament control, such as to control the deployment of the associated store. The aircraft controls and displays module typically includes both discrete controls, such as toggle switches, as well as a joystick for positioning and selecting a cursor within the associated display. The aircraft controls and displays module also provides the necessary avionics to fly the aircraft and to communicate with other aircraft and ground base control stations.

The bidirectional communication between the host aircraft and at least some associated missiles is further facilitated by a second type of store, namely, a data link pod. The data link pod, such as an AN/AWW-13 or AN/AWW-14 data link pod, is associated with the missile to provide a video interface with the aircraft controls and displays module. For example, a data link pod is typically employed in conjunction with a SLAM missile to provide an RF data link between the SLAM missile and the host aircraft.

Both the aircraft and the associated store typically process signals according to a predetermined format. As used herein, format refers not only to the actual configuration of the data structures, but also to the content and order of transmission of the signals. The predetermined formats of the aircraft and the store are oftentimes different. In order to ensure proper signal reception by the host aircraft and the associated store, the signals must thus be provided to the aircraft or store in the predetermined format that the aircraft or store is adapted to process.

In addition, each different type of aircraft and each different type of store generally processes signals according to a different predetermined format. In order to ensure that signals are transmitted between the aircraft and the associated store according to the proper predetermined format, each store is typically adapted to be mounted and deployed by only predetermined types of aircraft. Thus, a missile and its associated data link pod, if any, can be configured to process signals according to the predetermined format of the predetermined types of aircraft from which it is adapted to be deployed in order to ensure proper transmission of signals therebetween. By limiting each type of store to deployment from only certain predetermined types of aircraft, however, the flexibility with which stores can be deployed from aircraft is significantly restricted.

Likewise, aircraft are typically designed to interface with and deploy only one or more predetermined types of stores to ensure that signals are properly transmitted therebetween. By limiting each aircraft in the types of stores which it can deploy, however, the flexibility with which aircraft can deploy stores is further restricted.

One method and system for controlling and monitoring a store is disclosed in U.S. Pat. No. 5,036,465 issued Jul. 30, 1991 to Ackramin, Jr. et al. (the '465 patent), U.S. Pat. No. 5,036,466 issued Jul. 30, 1991 to Fitzgerald et al. (the '466 patent) and U.S. Pat. No. 5,129,063 issued Jul. 7, 1992 to Sianola et al. (the '063 patent), each of which are assigned to Grumman Aerospace Corporation. The '465, '466 and '063 patents disclose data processing systems for supporting an armament system. In particular, the '465, '466 and '063 patents disclose methods and systems for deploying several types of stores from a single aircraft.

The systems and methods disclosed in the '465, '466 and '063 patents, however, require modification of the central control processor of the aircraft and the addition of even more interface electronics to the aircraft controls and display module. Accordingly, the methods and systems of the '465, '466 and '063 patents further increase the demand on the central control processor of the aircraft which must not only process flight and targeting data, but also must provide an interface with a variety of types of stores. The store control and monitoring system of the '456, '466 and '063 patents is further limited by requiring the type of aircraft from which the store is to be deployed to be known in order to properly configure the central control processor and the aircraft controls and displays unit to interface with the different types of stores.

Therefore, to increase the flexibility with which stores can be deployed from aircraft such that a plurality of types of stores could be launched from a plurality of types of aircraft, the McDonnell Douglas Corporation, now a subsidiary of the present assignee, developed the method and apparatus disclosed in U.S. Pat. No. 5,548,510, the entire disclosure of which is incorporated herein by reference. This apparatus comprises a universal electrical interface that can be added onto an aircraft without having to modify the existing aircraft central control processor, and that enables the aircraft controls and displays module to communicate with any of a plurality of stores requiring different data formats.

A further improvement of the universal electrical interface of the '510 patent is disclosed in commonly owned U.S. Pat.

No. 5,931,874, the entire disclosure of which is incorporated herein by reference. The '874 patent describes an electrical interface that enables a video image transmitted from a missile after launch to be displayed on a visual display associated with the controls and displays module of the aircraft. The interface also includes a processor that defines a menu of commands for controlling the missile, a video graphics generator that generates a cursor, and a video mixer that overlays the menu of commands and the cursor onto the video image displayed on the visual display. The crew member can control the cursor by moving an input device, such as a joystick, so as to move the cursor over the menu of commands displayed on the display, and can select any of the commands to be sent to the missile via the data link pod.

The video interface apparatus described in the '874 patent can be used, for example, for controlling a precision-guided missile in a "man-in-the-loop" control mode, wherein the crew member places the cursor onto a selected location on the video image being received from the missile, the selected location thereby being identified to the missile as the desired target, and the missile locks onto the target and guides itself, via a guidance unit aboard the missile, so as to intercept the target.

Some precision-guided missiles are also capable of operating in an "automatic target recognition" (ATR) or "automatic target acquisition" (ATA) mode. In an ATR/ATA mode, a visual image of a desired target is acquired, for example by satellite photography or by some other type of sensor. Additionally, the coordinates of the target are determined, for example by a Global Positioning System (GPS). The image of the target and the target coordinates are downloaded into a memory unit of the missile prior to the aircraft taking off. The missile has a seeker operable to acquire image data as the missile flies, and a guidance unit aboard the missile is operable to compare the image data with the stored image of the desired target and to recognize the desired target when it is sensed by the seeker. The guidance unit then flies the missile so as to intercept the target.

Planning of the mission of a missile is currently done on the ground prior to the aircraft taking off. Mission planning involves, for example, plotting a series of waypoints along which the missile is to fly after it is launched, designating a target, and downloading these waypoints and the target into the missile's memory unit. Mission planning may also involve downloading the target image data and target location data (e.g., GPS coordinates) into the missile's memory unit. In the case of the SLAM-ER missile manufactured by the present assignee, the target image and target location data are formatted on the ground with a computer that is separate from the aircraft, and the formatted data are then transferred onto a data storage "cassette." The cassette is carried on board the aircraft (the F/A-18 aircraft being the only aircraft currently supporting the SLAM-ER capabilities), and the data are downloaded to the missile through the aircraft system. Once the aircraft is in flight, no additional mission-planning data can be downloaded to the missile.

It would be desirable to be able to plan a mission in real time during flight of the aircraft. For example, it would be desirable to be able to select a new target different from one previously stored in the missile, and to download the target information to the missile during aircraft flight.

It would also be desirable to be able to use precision-guided missiles (PGMs) on more than one type of aircraft without having to make modifications to the existing aircraft wiring and central processor. For example, the SLAM-ER missile currently can be used only on the F/A-18 aircraft. Other types of aircraft on which it would be desirable to be able to use the SLAM-ER missile include maritime patrol aircraft (MPA) such as the Navy S-3B, the P-3C, the UK Nimrod, international P-3Cs, and others. However, these aircraft cannot currently support the SLAM-ER capabilities because the SLAM-ER, and the AN/AWW-13 data link pod that is used for communicating with the missile after launch, are designed to interface with a MIL-STD 1760 interface, and the above aircraft are not equipped with this interface, and their central processors used for configuring and launching a missile do not provide data in the format required by the SLAM-ER and AWW-13 pod. Additionally, these aircraft are unable to support the use of target image data (such as acquired by satellite surveillance) in an ATR control mode. It would be desirable to provide some means of converting non-PGM-capable aircraft to have PGM capabilities without having to modify existing aircraft processors and wiring.

SUMMARY OF THE INVENTION

The above needs are met and other advantages are achieved by the present invention, which provides apparatus and methods for interfacing between an aircraft controls and displays module and a precision-guided missile such that mission-planning data can be downloaded to the missile during aircraft flight and prior to missile launch. In accordance with a preferred embodiment of the invention, an apparatus for providing an interface between a controls and displays module and a missile having ATR capability comprises a target image data interface unit operable to receive target image data from the controls and displays module of the aircraft in a first predetermined format and to translate said target image data into a second predetermined format usable by the missile, and a target location data interface unit operable to receive target location data from the controls and displays module of the aircraft in a third predetermined format and to translate said target location data into a fourth predetermined format usable by the missile. The interface units each are adapted to be connected to a data bus of the aircraft that is connected to the missile such that target image and location data can be downloaded over the data bus to the missile while the aircraft is in flight and prior to launch of the missile, whereby the apparatus permits in-flight mission planning for the missile.

A further advantage of some embodiments of the invention is the ability to perform real-time mission planning, for example by determining waypoints along a path to be flown by the missile after launch, and to download the mission-planning data to the missile prior to launch. For this purpose, it is advantageous to have access to terrain and elevation data for the geographic region in which the missile is to operate, so that the flight path can avoid terrain features such as mountains. To this end, the apparatus of the invention advantageously also includes a map storage unit operable to store terrain and elevation data for a geographic region in which the missile is to operate, and a mission-planning unit in data communication with the map storage unit. The mission-planning unit is operable to bidirectionally communicate with the controls and displays module for displaying the terrain and elevation data on a visual display of the controls and displays module and for receiving mission-planning commands from the controls and displays module and sending the mission-planning commands over the data bus to the missile prior to launch.

The mission-planning unit preferably is operable to receive the mission-planning commands in digitized form from an input device of the controls and displays module. The input device may comprise, for example, a keyboard. The apparatus preferably includes a microprocessor, and the target image data interface unit, the target location data interface unit, and the mission-planning unit are implemented within the microprocessor. Advantageously, a memory device that stores executable routines is in data communication with the mission-planning unit, the mission-planning unit executing the routines so as to implement functions of the interface units and to communicate with the controls and displays module and the missile.

In some preferred embodiments of the invention, adapted for use on an aircraft that carries a data link pod operable to communicate with the missile after launch, the apparatus further comprises a data link interface unit adapted to be connected between the controls and displays module and the data link pod. The data link interface unit is operable to process video image data received by the data link pod from the missile after launch, such that the video image data can be displayed on a visual display of the controls and displays module. The data link interface unit is further operable to process command signals generated in the controls and displays module and communicate said command signals to the data link pod for transmission to the missile after launch.

The data link interface unit in preferred embodiments includes a video processor operable to receive digitally encoded video image data provided by the data link pod and to decode the video image data into a format suitable for displaying on the visual display of the controls and displays module. The video processor advantageously comprises a video mixer and a video graphics generator. The video graphics generator is operable to generate a cursor and a menu of commands available to a crew member, and is coupled with the video mixer such that the video mixer causes the visual display of the commands and displays module to display a video image received from the missile overlaid by the menu of commands and cursor. A controller coupled with the video graphics generator is operable to receive positioning signals from an input device in the aircraft, and to cause the video graphics generator to position the cursor on the visual display responsive to the positioning signals. For example, a crew member may manipulate a joystick for positioning the cursor so as to select a command from the menu of commands and cause the command to be sent to the data link pod for transmission to the missile. The command may, for example, tell the missile to change from one control mode to another. The data link interface unit preferably is operable to continually process and relay control signals received from the commands and displays module to the data link pod for transmission to the missile for controlling the missile in a man-in-the-loop control mode.

The invention also provides a method for in-flight planning of a mission for a precision-guided missile carried by an aircraft for launching against a target, the missile being operable to automatically recognize a target as corresponding to a predetermined target defined by target image data stored in a memory unit of the missile and to guide the missile to the target based on target location data stored in the memory unit of the missile. The method comprises receiving target image data from a controls and displays module of the aircraft in a first predetermined format and translating said target image data into a second predetermined format usable by the missile; receiving target location data from the controls and displays module of the aircraft in a third predetermined format and translating said target location data into a fourth predetermined format usable by the missile; and downloading the translated target image and location data over a data bus to the missile while the aircraft is in flight and prior to launch of the missile. The target image data can be received by the aircraft by transmission from a sensor remote from the aircraft, as can the target location data. The data would typically be encoded in a particular format, and would require reformatting before being downloaded to the missile. As noted above, this process is currently done on the ground before aircraft takeoff. With the present invention, however, the data can be reformatted and downloaded to the missile during aircraft flight prior to missile launch. The invention thus allows in-flight mission planning for precision-guided missiles equipped to operate in an ATR mode.

The method of the invention preferably also includes storing terrain and elevation data for a geographic region in which the missile is to operate after launch in a data storage device aboard the aircraft; retrieving and displaying the terrain and elevation data on a visual display aboard the aircraft; determining missile mission parameters during flight of the aircraft prior to launch of the missile based on the terrain and elevation data displayed on the visual display; and downloading the missile mission parameters over the data bus to the missile prior to launch.

In other embodiments, the method includes using a data link pod carried by the aircraft to receive a video image transmitted by the missile after launch and to generate video image data; processing the video image data generated by the data link pod and displaying the processed video image data on a video display aboard the aircraft; using the displayed video image data to determine control commands for altering the mission of the missile; and sending said control commands to the data link pod for transmission to the missile after launch. For example, a control command can be sent for causing the missile mission to be changed from an automatic target-recognition mode to a man-in-the-loop mode for controlling the flight of the missile.

BRIEF DESCRIPTION OF THE DRAWINGS

The above and other objects, features, and advantages of the invention will become more apparent from the following description of certain preferred embodiments thereof, when taken in conjunction with the accompanying drawings in which.

DETAILED DESCRIPTION OF THE DRAWINGS

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 1:
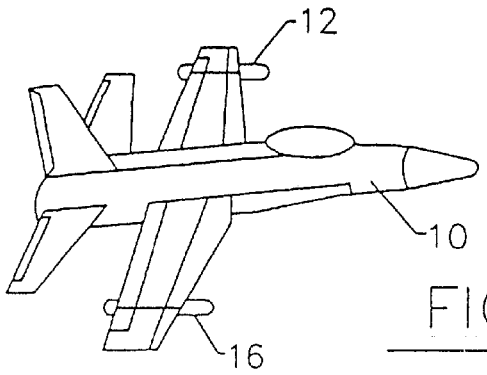
FIG. 1 is a perspective view showing an aircraft carrying a data link pod and a precision-guided missile.

With reference to FIG. 1, an aircraft 10 is shown carrying a precision-guided missile 12 and a data link pod 16. The missile 12 may be, for example, a SLAM-ER missile that is capable of being operated in various control modes including a man-in-the-loop (MITL) mode and an automatic target recognition (ATR) mode. The data link pod 16 may be, for example, an AWW-13 data link pod having SLAM-ER capabilities. It should be understood, however, that these missile and data link pod configurations are merely examples of the types that can be used with the present invention, and the invention can be used with other types of precision-guided missiles and associated data link pods.

The data link pod 16 provides a radio frequency (RF) interface between the aircraft 10 and the missile 12 after the missile has been launched from the aircraft. Where the missile 12 is a SLAM-ER missile, the data link pod 16 advantageously comprises an AWW-13 data link pod developed by the Naval Avionics Center, and described in Publication No. 1342AS114 dated Nov. 15, 1988 by the Naval Avionics Center. The RF link between the aircraft and the missile enables the aircraft crew to issue commands to the missile while the missile is en route to its target destination, for example for performing a mid-course correction of the missile's flight path.

Figure 2:
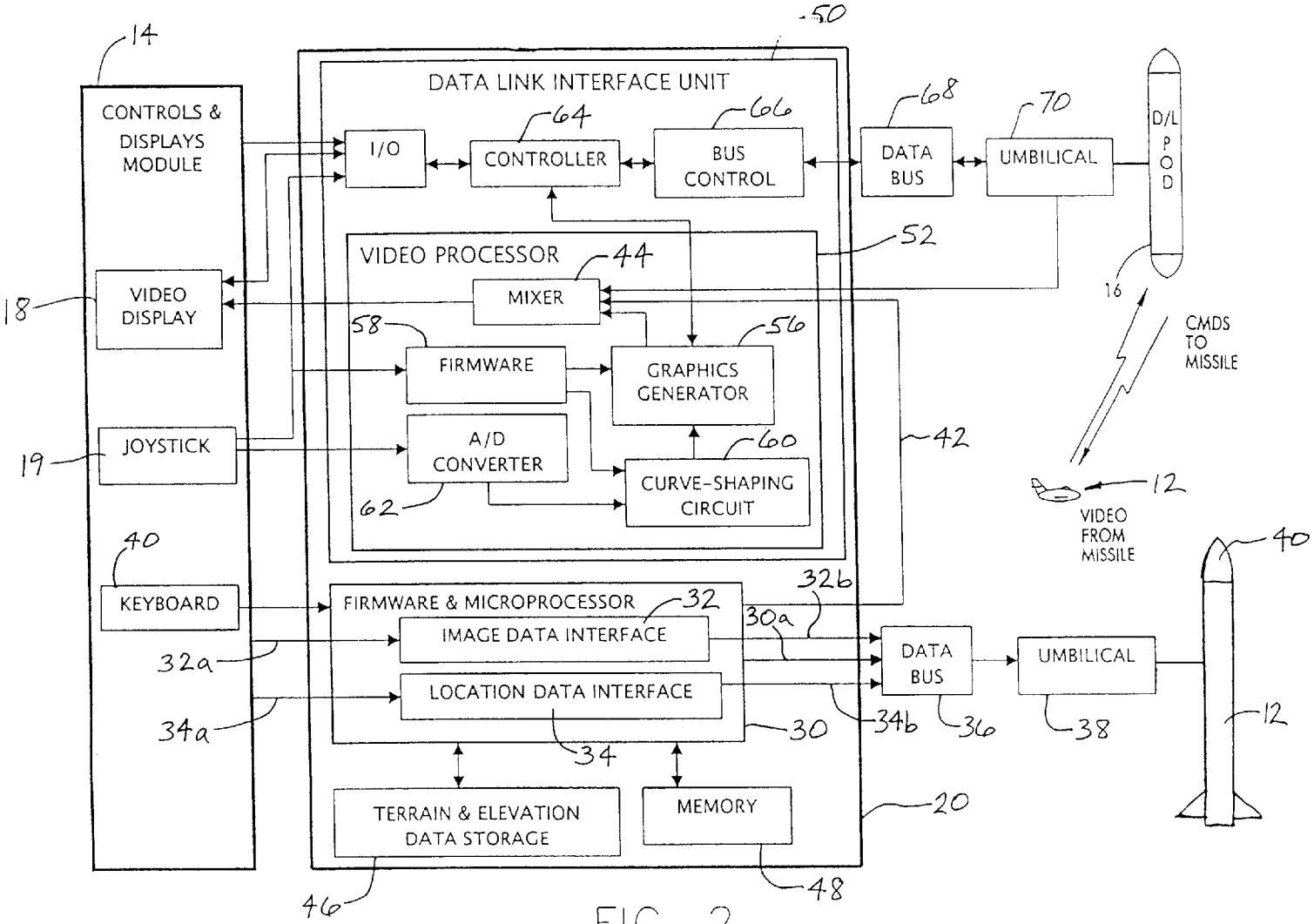
FIG. 2 is a block diagram illustrating one embodiment of an interface apparatus in accordance with the present invention for providing communication between an aircraft controls and displays module and a data link pod and precision-guided missile.

The aircraft 10 includes a controls and displays module 14 (FIG. 2). This module provides electrical circuitry that controls the flight of the aircraft and the deployment of the armament systems, including the deployment of an associated missile 12. The controls and displays module also provides a display for the crew such that they can further monitor the flight of the aircraft and the deployment of the associated missiles. The aircraft controls and displays module is also adapted to receive input from the crew to control the flight of the aircraft and the deployment of the associated missile. Thus, the exemplary controls and displays module 14 shown in FIG. 2 includes a video display 18 for displaying a video image transmitted from the missile 12 to the data link pod 16 as the missile is en route to its target. The controls and displays module also includes a joystick 19 that a crew member can use to move a cursor on the video display 18 for interacting with the missile after launch, as further described below.

To perform these and other functions, the aircraft controls and displays module 14 processes a variety of signals according to a predetermined format. Each type of aircraft 10 generally processes signals according to a different predetermined format. In addition, the aircraft controls and displays module of each different type of aircraft typically includes a different set of controls and displays through which the crew of the aircraft interact with the aircraft controls and displays module to fly the aircraft and deploy any associated missile 12. According to the present invention, the aircraft 10 also includes an electrical interface 20, also referred to as a universal signal conditioning apparatus or pod adapter unit (PODAU), which provides a universal electrical interconnection between the aircraft controls and displays module 14 and an associated store (e.g., missile 12 and/or data link pod 16). Advantageously, the electrical interface 20 enables aircraft 10 to deploy a plurality of different types of missiles 12, at least some of which process signals according to a different predetermined format than the aircraft controls and displays module 14. Commonly assigned U.S. Pat. No. 5,548,510, incorporated herein by reference, discloses a preferred universal signal conditioning apparatus enabling a plurality of different controls and displays modules to communicate with a plurality of different types of stores. The present invention can be used in conjunction with a universal signal conditioning apparatus as disclosed in the '510 patent, or can be used independent of such universal signal conditioning apparatus.

As illustrated in FIG. 2, one embodiment of the electrical interface 20 is preferably disposed between and bidirectionally communicates with the aircraft controls and displays module 14 and the missile 12. The electrical interface 20 preferably provides the missile 12 with power, typically three-phase power, and a release signal that triggers the deployment of the missile. In addition, the electrical interface 20 of this embodiment bidirectionally communicates with the data link pod 16 which, in turn, is adapted to communicate via RF signals with an associated missile, such as a SLAM-ER missile. While the RF data link can be established between the data link pod and the missile prior to deployment, the RF data link is typically established during or following deployment such that the missile can transmit a video image, such as of the target, to the data link pod and, in turn, to the aircraft controls and displays module 14. As known to those skilled in the art, only predetermined types of missiles, such as SLAM-ER missiles, are adapted to communicate via an RF data link with a data link pod to provide video images following deployment according to this embodiment of the present invention. As described thus far, the electrical interface 20 is similar to the universal signal conditioning apparatus disclosed in the '510 patent. The electrical interface 20 of the present invention, however, includes features particularly suited for communicating with and deploying precision-guided missiles (PGMs), such as the SLAM-ER missile. The interface 20 also enables real-time mission planning to be done during aircraft flight prior to missile deployment.

To these ends, the interface 20 includes a mission-planning unit 30 that bidirectionally communicates with the controls and displays module 14 and with the missile 12 such that mission-planning information can be downloaded to the missile at any time prior to launch. The mission-planning unit 30 advantageously includes a target image data interface unit 32 and a target location data interface unit 34. The image data interface unit 32 is operable to receive target image data 32*a* from the controls and displays module 14 in a predetermined format. For example, the aircraft can include a receiver (not shown) for receiving a transmission of target image data acquired by a national sensor, such as by satellite surveillance. The target image data may be, for example, in a format known as "NTIF Confidence Level 6" format. The missile, however, typically would not be capable of storing the image data in this format. The image data interface unit 32 reformats the target image data 32*a* into a format usable by the missile, and sends the reformatted image data 32*b* over a data bus 36 to the missile 12. As an example, where the target image data 32*a* is received in NTIF Confidence Level 6 format, the image data interface unit 32 incorporates the data into "targeting data blocks" and sends the targeting data blocks to the missile. The missile 12 is typically electrically connected to the aircraft data bus 36 by a disconnectable umbilical cable 38 that allows the missile 12 to disconnect from the umbilical upon launch.

The target location data interface unit 34 is operable to receive target location data 34*a* from the controls and displays module 14 of the aircraft in a predetermined format. For example, the aircraft can include a receiver (not shown) for receiving target location data from a remote transmitter (not shown). The location data may include, for example, the GPS (Global Positioning System) coordinates of the target. The GPS data may be received in RS 422 format. However, the missile 12 would typically not be equipped to store and use the location data in such format. Thus, the location data interface unit 34 reformats the data into a format usable by the missile, and sends the reformatted location data 34*b* over the aircraft data bus 36 and through the umbilical 38 to the missile. The target image data 32*b* and target location data 34*b* are stored in a memory unit (not shown) on board the missile 12.

As already noted, the SLAM-ER, and other types of precision-guided missiles, includes the capability of operating in an automatic target recognition (ATR) control mode, whereby a mid-course guidance unit (MGU, not shown) on board the missile is operable to receive image data acquired during missile flight by a seeker head 40 and to compare the image data to the internally stored target image data 32*b*. The seeker head 40 typically includes an infrared imaging device (not shown) that acquires infrared images of a scene toward which the missile is directed. The MGU on board the missile is able to recognize when the imaged scene acquired by the imaging device matches the internally stored target image, and can then "lock onto" the target and guide the missile so as to intercept the target. The MGU may also include a missile position sensor (not shown), such as a GPS unit, and may compare the target location data 34*b*, such as GPS coordinates, to the sensed position of the missile to assist in guiding the missile to the target.

The mission-planning unit 30 advantageously comprises a microprocessor (e.g., a "PC on a card") that operates in conjunction with "firmware" (e.g., an EPROM) so as to execute the functions of the image data interface unit 32 and location data interface unit 34. The firmware advantageously stores executable routines and data that are used by the microprocessor to cause the functions of the interface units to be carried out. The microprocessor and firmware advantageously can be included on one or more circuit cards that can be added into an existing avionics equipment bay on the aircraft so as to interface with the controls and displays module 14 and the aircraft data bus 36. Thus, the invention provides an add-on unit that can be added to an aircraft to provide the aircraft with the capability of downloading mission-planning information to a missile at any time prior to missile deployment.

Mission planning for the missile is facilitated in preferred embodiments of the invention by the mission-planning unit 30, which is operable to receive command signals from an input device of the aircraft displays and commands module 14. As shown, the input device advantageously comprises a keyboard 40. The mission-planning unit 30 preferably is further operable to generate mission-planning information 42 and send the mission-planning information to a video mixer 44 of the interface 20, the video mixer 44 being operable to cause the information to be displayed on the video display 18 of the controls and displays module. The crew member can, for example, use the keyboard 40 to input mission-planning commands and data, such as a series of waypoints along which the missile is to fly, and see the input commands and data displayed on the video display 18. In this way, the crew member generates, via the mission-planning unit 30, a set of mission-planning commands and data 30*a* that is downloaded over the data bus 36 and umbilical 38 to the missile.

The interface 20 of the invention preferably also includes a terrain and elevation data storage unit 46 for facilitating mission planning. The terrain and elevation data storage unit 46 is operable to store terrain and elevation data, advantageously in digital form, for a geographic region in which the missile is to operate after launch. The terrain and elevation data storage unit 46 can comprise, for example, a compact disc (CD) player in which a CD containing digital terrain and elevation data (DETD). The storage unit 46 is in communication with the mission-planning unit 30, which is operable to cause the terrain and elevation data to be displayed on the video display 18 for use by a crew member in planning a mission. Thus, the crew member can plan waypoints, for example, in such a way as to avoid terrain features such as mountains that may otherwise interfere with the flight of the missile.

The interface 20 can also include a memory device 48, such as one or more hard disk drives, in communication with the mission-planning unit 30 and storing executable routines and/or data used by the mission-planning unit. It will also be understood that the mission-planning unit 30 includes or is coupled with a random-access memory (RAM, not shown) and a read-only memory (ROM, not shown) for facilitating execution of the executable routines.

Figure 3:
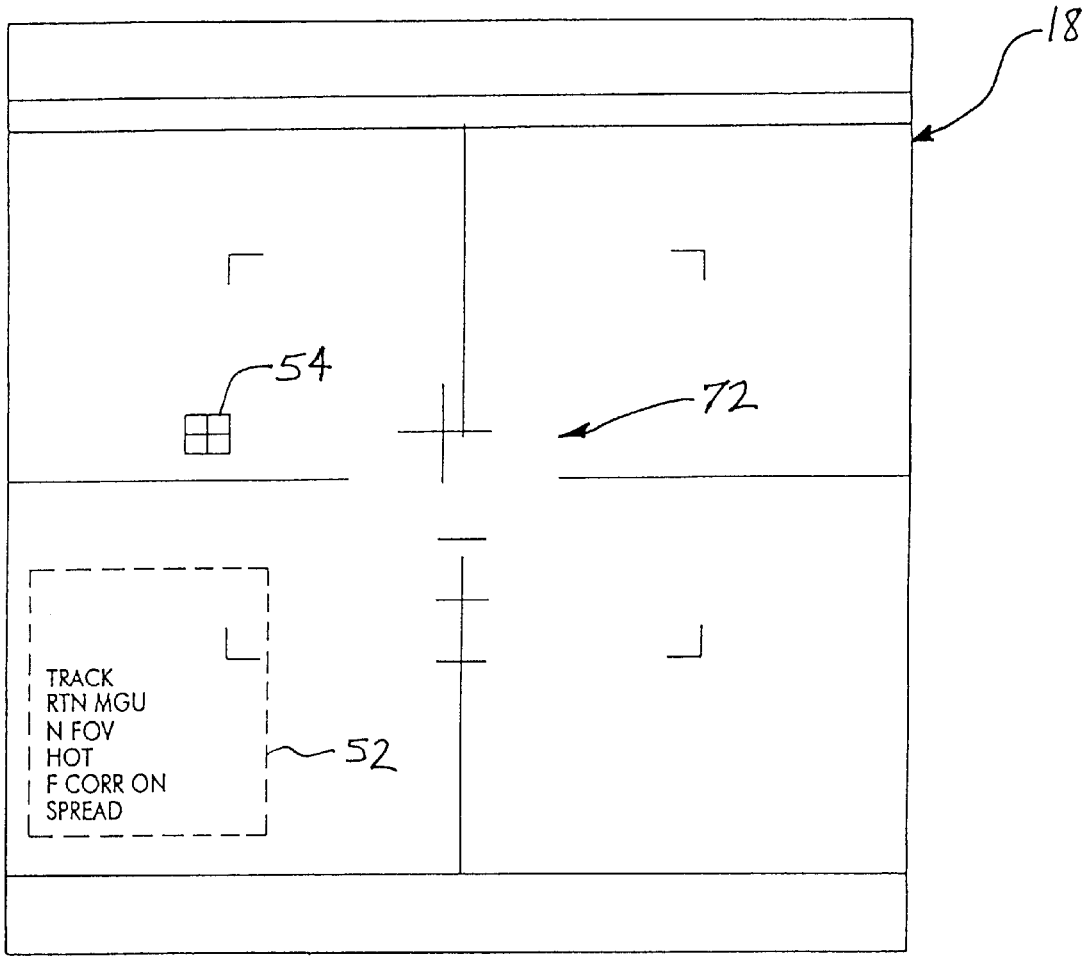
FIG. 3 is an exemplary screen display generated by the video processor of the apparatus shown in FIG. 2.

In accordance with a preferred embodiment of the invention as shown in FIG. 2, the interface 20 also includes a data link interface unit 50 for bidirectionally communicating between the controls and displays module 14 and the data link pod 16. The embodiment of the data link interface unit 50 depicted in FIG. 2 is substantially as described in U.S. Pat. No. 5,931,874, which is incorporated herein by reference, and thus will not be described in detail herein. Suffice it to say that the data link interface unit 50 includes a video processor 52 operable to display, on the video display 18 of the controls and displays module, a video image received from the missile by the data link pod 16. The video processor is further operable to overlay on the video image a menu of commands 52 (FIG. 3) and a cursor 54 for use by a crew member in selecting commands to be issued to the missile, via the data link pod, after launch. The video processor 50 includes a video mixer 44 that receives video image data from the data link pod 16 and processes it so that it can be displayed on the video display 18. The video processor 50 also includes a video graphics generator 56 that operates in conjunction with firmware 58 so as to respond to commands from the aircraft and generate the commands menu 52 and cursor 54, and feeds them to the video mixer for display. A curve-shaping circuit 60 receives slew voltage signals sent from an input device such as the joystick 19 (via an analog-to-digital converter 62, if the joystick 19 provides digital signals), and normalizes the slew voltages so that the cursor movement will be the same from one aircraft type to another. The normalized slew voltages are fed to the graphics generator for generating the cursor 54. The menu of commands 52 is generated in the firmware 58 and fed to the graphics generator 56. The crew member manipulates the joystick 19 to move the cursor 54 over a selected one of the commands in the menu 52, and then activates a switch (not shown) that advantageously may be a trigger on the joystick, which causes a designating command to be issued and sent to the firmware 58. The firmware 58 determines whether a designation has been made and, if it has, the selection is transmitted to a controller 64, which processes signals received from the controls and displays module 14 so that the data link pod 16 can use them, and likewise processes signals received from the data link pod 16 so that the controls and displays module can use them. The controller 64 sends the command, via a bus controller 66, over a data bus 68 through an umbilical 70 to the data link pod 16 for transmission to the missile 12. As an example, the command RTN MGU causes the mid-course guidance unit to change from one control mode to another, such as from a TRACK mode wherein the missile lock onto and tracks a target defined by a missile cursor 72 (FIG. 3) whose location on the display 18 is controlled by the crew member, to a mid-course guidance mode wherein the missile flight path is controlled by the mid-course guidance unit aboard the missile. It is also contemplated that the menu of commands 52 may include a command causing the missile to be changed from an automatic target recognition (ATR) mode to a man-in-the-loop (MITL) mode such as the TRACK mode described above. Other commands are possible, including those described in the '874 patent as well as others that may be specific to precision-guided missiles such as the SLAM-ER.

As previously noted, the SLAM-ER missile and AWW-13 data link pod are designed to interface with a MIL-STD 1760 interface. It is contemplated that on aircraft that are not equipped with MIL-STD 1760 wiring, special MIL-STD 1760 umbilicals 38, 70 can be used for interfacing between the missile 12 and data link pod 16 and the existing aircraft wiring. For example, suitable umbilicals for this purpose are disclosed in commonly owned U.S. patent application Ser. No. 09/191,884 filed Nov. 13, 1998, now U.S. Pat. No. 6,122,569 which is incorporated herein by reference. Thus, the electrical interface 20 and umbilicals 38, 70 enable a plurality of different aircraft to support the SLAM-ER missile and data link pod.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. An apparatus for providing an electrical interface between a controls and displays module of an aircraft and a precision-guided missile carried by the aircraft for launching against a target, the missile automatically recognizing a target as corresponding to a predetermined target defined by target image data stored in a memory unit of the missile and guiding the missile to the target based on target location data stored in the memory unit of the missile, the aircraft including means for providing target image and location data, the apparatus comprising a mission-planning unit including:

a target image data interface unit that receives target image data from the controls and displays module of the aircraft in a first predetermined format and translates said target image data into a second predetermined format usable by the missile; and a target location data interface unit that receives target location data from the controls and displays module of the aircraft in a third predetermined format and translates said target location data into a fourth predetermined format usable by the missile;

the interface units each being connected to a data bus of the aircraft that is connected to the missile such that target image and location data are downloaded over the data bus to the missile while the aircraft is in flight and prior to launch of the missile, whereby the apparatus permits in-flight mission planning for the missile.

2. The apparatus of claim 1, further comprising a map storage unit that stores terrain and elevation data for a geographic region in which the missile is to operate, the mission-planning unit being in data communication with the map storage unit and bidirectionally communicating with the controls and displays module for displaying the terrain and elevation data on a visual display of the controls and displays module and for receiving mission-planning commands from the controls and displays module and sending the mission-planning commands over the data bus to the missile prior to launch.

3. The apparatus of claim 2, wherein the mission-planning unit receives the mission-planning commands in digitized form from an input device of the controls and displays module.

4. The apparatus of claim 2, wherein the mission-planning unit includes a microprocessor, and wherein the target image data interface unit, the target location data interface unit, and the mission-planning unit are implemented within the microprocessor.

5. The apparatus of claim 4, further comprising a memory device that stores executable routines and is in data communication with the mission-planning unit, the mission-planning unit executing said routines so as to implement functions of the interface units and to communicate with the controls and displays module and the missile.

6. The apparatus of claim 1, for use on an aircraft that carries a data link pod operable to communicate with the missile after launch, the apparatus further comprising a data link interface unit connected between the controls and displays module and the data link pod, the data link interface unit processing video image data received by the data link pod such that the video image data can be displayed on a visual display of the controls and displays module, the data link interface unit processing command signals generated in the controls and displays module and communicating said command signals to the data link pod for transmission to the missile after launch.

7. The apparatus of claim 6, wherein the data link interface unit includes a video processor that receives digitally encoded video image data provided by the data link pod and decodes the video image data into a format suitable for displaying on the visual display of the controls and displays module.

8. The apparatus of claim 7, wherein the video processor comprises a video mixer and a video graphics generator, the video graphics generator generating a cursor and a menu of commands available to a crew member, the video graphics generator being coupled with the video mixer such that the video mixer causes the visual display of the commands and displays module to display a video image received from the missile overlaid by the menu of commands and cursor.

9. The apparatus of claim 8, further comprising a controller coupled with the video graphics generator, the controller receiving positioning signals from an input device in the aircraft and causing the video graphics generator to position the cursor on the visual display responsive to the positioning signals.

10. The apparatus of claim 6, wherein the data link interface unit communicates an override command generated in the commands and displays module to the data link pod such that the override command is transmitted to the missile after launch for altering a mission stored in the missile prior to launch.

11. The apparatus of claim 6, wherein the data link interface unit continually processes and relays control signals received from the commands and displays module to the data link pod for transmission to the missile for controlling the missile in a man-in-the-loop control mode.

12. A method for in-flight planning of a mission for a precision-guided missile carried by an aircraft for launching against a target, the missile automatically recognizing a target as corresponding to a predetermined target defined by target image data stored in a memory unit of the missile and guiding the missile to the target based on target location data stored in the memory unit of the missile, the aircraft including means for providing target image and location data, the method comprising:

receiving target image data from a controls and displays module of the aircraft in a first predetermined format and translating said target image data into a second predetermined format usable by the missile;

receiving target location data from the controls and displays module of the aircraft in a third predetermined format and translating said target location data into a fourth predetermined format usable by the missile; and downloading the translated target image and location data over a data bus to the missile while the aircraft is in flight and prior to launch of the missile, whereby the method permits in-flight mission planning for the missile.

13. The method of claim 12, further comprising:

storing terrain and elevation data for a geographic region in which the missile is to operate after launch in a data storage device aboard the aircraft;

retrieving and displaying the terrain and elevation data on a visual display aboard the aircraft;

determining missile mission parameters during flight of the aircraft prior to launch of the missile based on the terrain and elevation data displayed on the visual display; and downloading the missile mission parameters over the data bus to the missile prior to launch.

14. The method of claim 12, further comprising:

using a data link pod carried by the aircraft to receive a video image transmitted by the missile after launch and to generate video image data;

processing the video image data generated by the data link pod and displaying the processed video image data on a video display aboard the aircraft;

using the displayed video image data to determine control commands for altering the mission of the missile; and sending said control commands to the data link pod for transmission to the missile after launch.

15. The method of claim 14, wherein sending said control commands comprises sending a command causing the missile mission to be changed from an automatic target-recognition mode to a man-in-the-loop mode for controlling the flight of the missile.

16. A method for in-flight planning of a mission for a precision-guided missile carried by an aircraft for launching against a target, the method comprising:

storing terrain and elevation data for a geographic region in which the missile is to operate after launch in a data storage device aboard the aircraft;

retrieving and displaying the terrain and elevation data on a visual display aboard the aircraft;

determining missile mission parameters during flight of the aircraft prior to launch of the missile based on the terrain and elevation data displayed on the visual display; and downloading the missile mission parameters to the missile prior to launch.

* * * * *